United States Patent [19]

Kristofek

[11] Patent Number: 4,626,969

[45] Date of Patent: Dec. 2, 1986

[54] WALL WASH TRACK LIGHTING FIXTURE

[75] Inventor: Paul Kristofek, Hickory Hills, Ill.

[73] Assignee: Cooper Industries, Inc., Houston, Tex.

[21] Appl. No.: 710,283

[22] Filed: Mar. 4, 1985

[51] Int. Cl.[4] ..... F21S 1/02

[52] U.S. Cl. ..... 362/147; 362/269; 362/306; 362/371; 362/426

[58] Field of Search ..... 362/145, 147, 148, 150, 362/217, 220, 223, 250, 269, 270, 285, 287, 300, 306, 307, 345, 347, 356, 368, 370, 371, 374, 404, 406, 426, 311; 339/21 R, 21 S

[56] References Cited

U.S. PATENT DOCUMENTS

| | | | |
|---|---|---|---|
| 3,755,666 | 8/1973 | Edgeington | 362/217 |
| 4,290,096 | 9/1981 | Szpur | 362/223 |
| 4,464,707 | 8/1984 | Forrest | 362/370 |
| 4,475,226 | 10/1984 | Greenberg | 362/370 |

FOREIGN PATENT DOCUMENTS

| | | | |
|---|---|---|---|
| 79492 | 1/1950 | Czechoslovakia | 362/220 |
| 225912 | 1/1968 | Sweden | 362/220 |
| 2106232 | 4/1983 | United Kingdom | 362/217 |
| 0857632 | 8/1981 | U.S.S.R. | 362/223 |

*Primary Examiner*—Craig R. Feinberg
*Assistant Examiner*—David A. Okonsky
*Attorney, Agent, or Firm*—Eddie E. Scott; Alan R. Thiele

[57] ABSTRACT

A channel shaped track lighting fixture has a light reflector mounted in a pair of aligned internal grooves. Removable end caps permit access to the interior of the lighting fixtures so that the reflector may be slid out of the fixture along the aligned internal grooves.

23 Claims, 11 Drawing Figures

FIG. 4
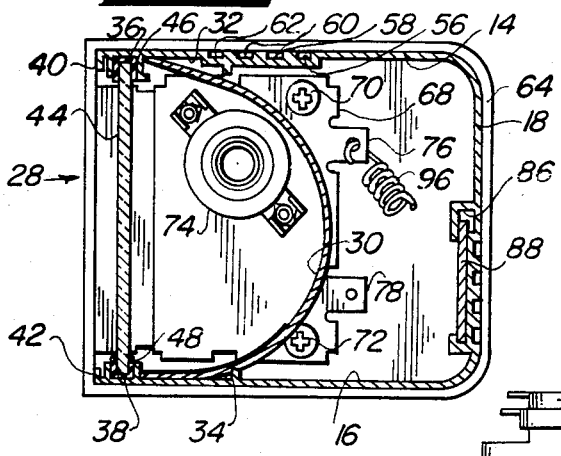
FIG. 5
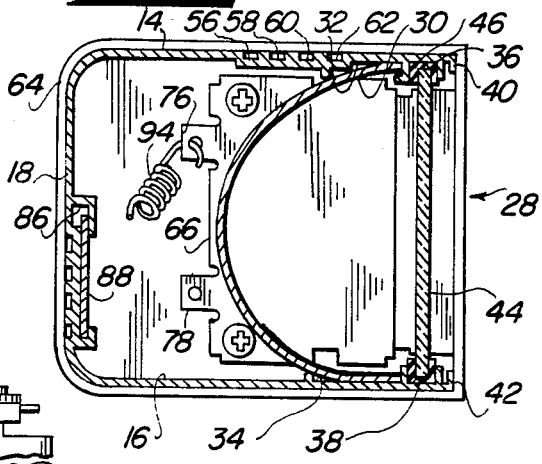
FIG. 6
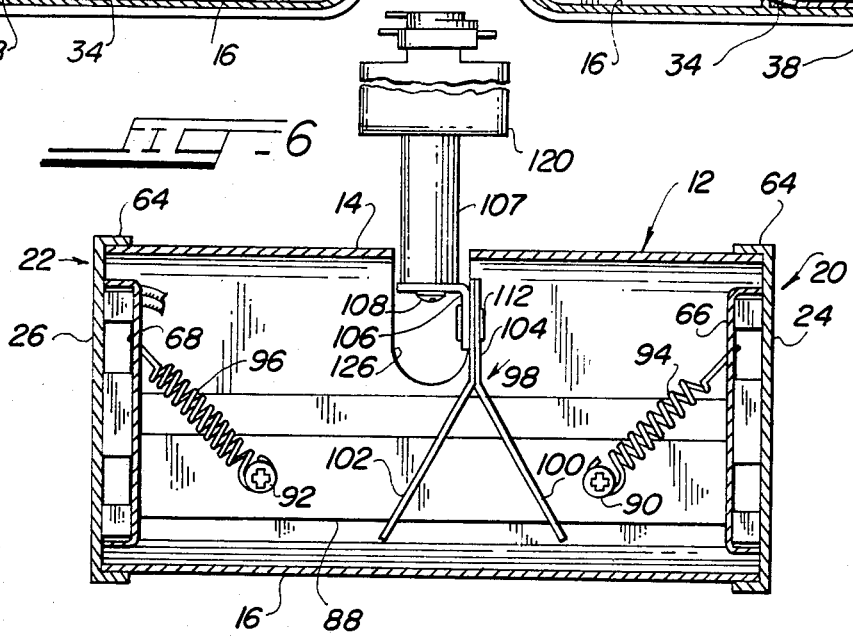
FIG. 7
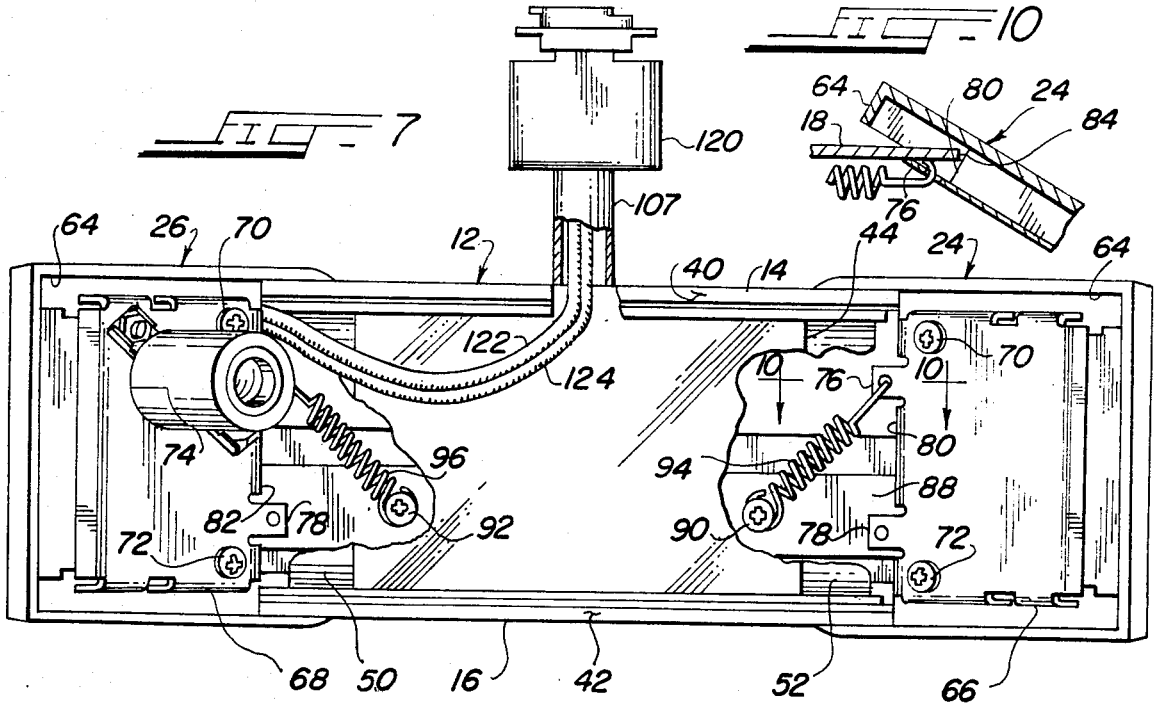
FIG. 10

10
64
12
14
64
24
56
58
9
50
62
28
52
44
26
132
9

132

128
40
46
36
14
32
74
44
48
30
42
130
38
34
16

WALL WASH TRACK LIGHTING FIXTURE

This invention relates to a lighting fixture of the type for use in a track lighting system. In particular, the invention relates to a track lighting fixture of the type known as a wall washer. This type of lighting fixture is secured to the track of the system which in turn is secured typically onto a ceiling or overhead member adjacent a wall or other vertical surface to be illuminated. The wall washer is typically adapted to be pivoted in a vertical plane so as to direct light at the wall or vertical surface so as to illuminate a particular area or to achieve a particular lighting effect. These lighting fixtures are designed in many decorative shapes, and sizes but have been subject to certain shortcomings particularly in regard to ease of servicing.

As is the case with all lighting fixtures, it is of course, required to replace the light source or to service the light reflector such as by cleaning or replacing. Additionally, although required less frequently, it may be necessary to replace or service the lamp socket or electrical leads and connections. Present fixtures of the wall wash type are for the most part not designed for easy serviceability except possibly for the light source itself, therefore, it would be highly desirable to provide for a track light fixture having increased serviceability.

Also, the light sources used with these fixtures generate considerable heat and are normally enclosed in a relatively small housing which confines and concentrates the heat which can build during operation to undesireably high and even dangerous levels. Heretofore, the fixtures have been left open at the front with the light source exposed so as to provide for both servicing of the bulb as well as for access of cooling ambient air to the hot bulb and reflector. Leaving the bulb exposed can be dangerous and, therefore, it would be desirable to provide for a light transparent safety lens that also provides for access of cooling air to the housing interior.

Further shortcomings of prior art wall washers has been the inability to obtain sharp light cut-off at both the top and the bottom of the light pattern. Sharp light cut-off is desirable for framing an object or area or for evenly illuminating the subject surface beginning, for example, at the interface of a wall and ceiling.

Further, it is often desirable to attach accessory items to the fixture such as a color filter, baffle, or adjustable barn door type shutter for achieving a particular lighting effect. It can be appreciated that these accessory items are intended to be temporarily attached and interchangeable and therefore attachment and removal from the fixture should be simple, fast and positive.

SUMMARY OF THE INVENTION

The present invention provides for a wall wash track lighting fixture that is easily serviced, provides for cooler, safer operation than prior art fixtures and produces uniform sharp light cut off at the top and bottom of the light pattern.

According to an important aspect of the invention, the housing of the fixture is an elongated, extruded channel shaped member open at opposing ends and at the front. The housing is provided with at least two pairs of aligned grooves in the top and the bottom walls for slideably receiving from either end of the housing an asymmetrically-shaped reflector and a transparent planar safety lens.

According to another important aspect of the invention, the reflector is an elongated, asymmetrically shaped reflector extending between the ends of the housing providing for a uniform field of illumination having sharp light cut-off at the top and bottom of the light pattern.

According to another important aspect of the invention, a pair of removeable end caps are mounted at each end of the housing with a pair of springs which bias and hold the caps against the housing across the open ends and allow for alternative positioning of the end caps removed from the housing ends.

A still further important feature of the invention provides for stop means on each end cap and at least one retention tab adapted to retain the end cap to the housing when removed from the open end.

Another feature of the invention provides for the lens to have a length less than the spacing between the end caps whereby a pair of air openings into the interior of the housing is created between the end caps and each end of the lens. The openings allow cooler ambient air to enter and circulate through the housing to cool the interior thereof.

Yet another important feature of the invention provides for a novel mounting structure for mounting the housing to the track of the lighting system including an elongated strap-like bracket slideably received in a slot provided in the back wall of the housing and a Y-shaped hanger pivotally attached to the bracket.

A wall fixture constructed according to the principles of the present invention is easily assembled and disassembled for servicing and provides for uniform illumination and sharp light cut off at the top and bottom of the light pattern. Further, the fixture operates cooler and safer than present fixtures.

BRIEF DESCRIPTION OF THE DRAWINGS

The important features as well as other aspects of the invention will become apparent and better understood after reading the following detailed description taken in connection with the accompanying drawings wherein:

FIG. 4 is a sectional view along line 4—4 of FIG. 2;

FIG. 5 is a sectional view along line 5—5 of FIG. 2;

FIG. 6 is a sectional view along line 6—6 of FIG. 1;

FIG. 7 is a front view and partial section of the device of the present invention;

FIG. 10 is a component view of the device shown in FIG. 7.

DETAILED DESCRIPTION OF THE PREFERRED EMBODIMENT

Figure 1:
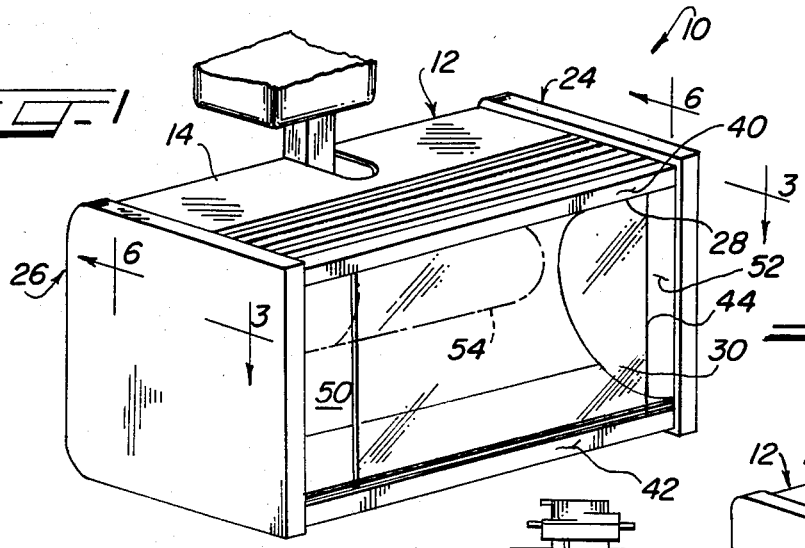
FIG. 1 is a perspective view of the lighting fixture of the present invention.
Figure 2:
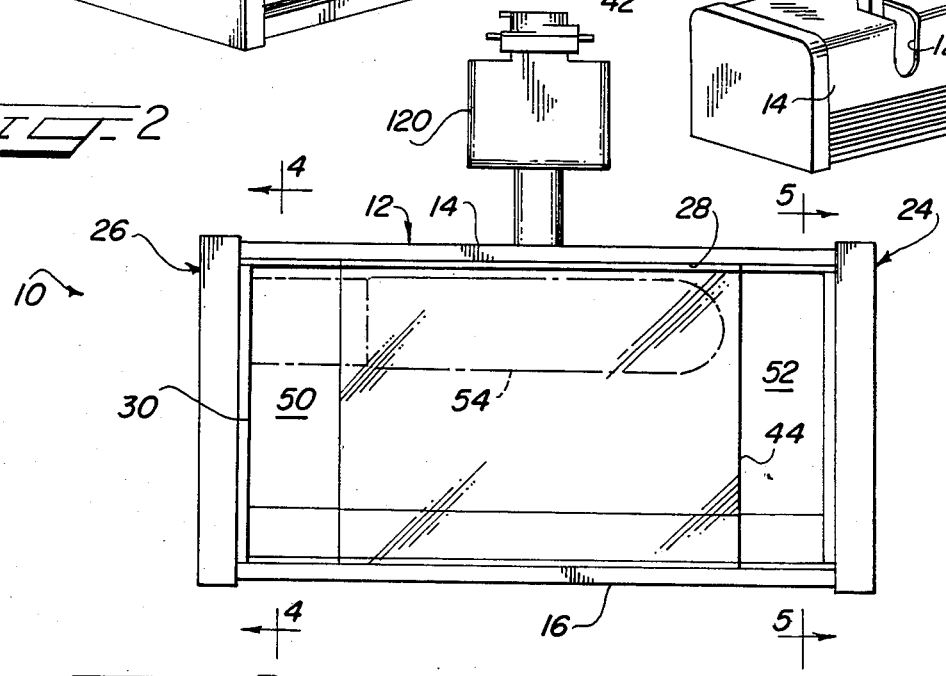
FIG. 2 is a front view of the lighting fixture shown in FIG. 1.
Figure 3:
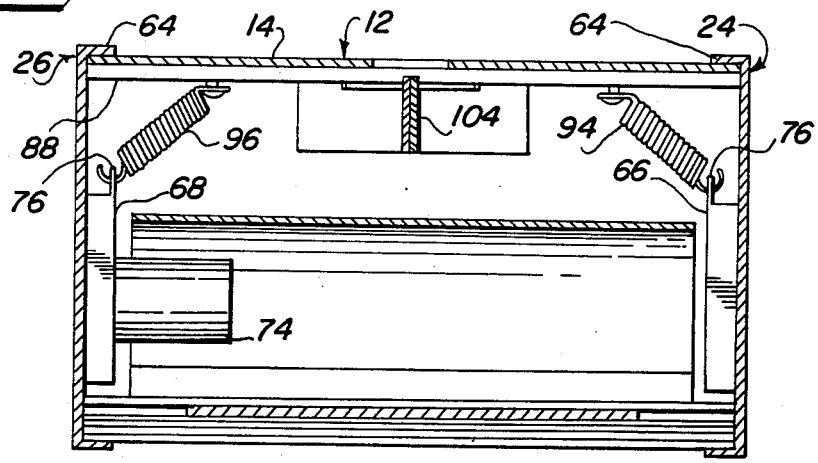
FIG. 3 is a view taken along the line 3—3 of FIG. 1.

Shown in FIGS. 1–4 is a wall wash track lighting fixture 10 including an elongated channel shaped extruded aluminum housing 12 having a top wall 14, a bottom wall 16 and a back wall 18 connected between the top and bottom walls. The housing is open at opposing ends 20, 22 and one end cap of a pair of end caps 24, 26 is mounted in each open end. As shown in the drawings, the housing is elongated forming a rectangular shaped frontal opening 28 behind which is mounted between the opposing ends an elongated asymmetrically shaped light reflector 30. The inner surfaces of the top wall 14 and the bottom wall 16 are provided with at least two pairs of aligned grooves 32, 34 and 36, 38 extending between the ends 20 and 22 of the housing 12. The first and innermost groove pair 32, 34 is a relatively wide groove and slideably receives therein from either open end the reflector 30. The second and intermediate groove pair 36, 38 is located forward of the innermost groove pair between the front edges 40, 42 of the housing and the first innermost groove pair 32, 34. Slideably received in the second intermediate groove pair 36, 38, also from either end of the housing, is a safety borosilicate glass lens 44. The lens 44 is retained in the second intermediate groove pair 36, 38 by a pair of channel shaped gaskets 46, 48 which slide into each groove, 36 and 38, and surround the opposing edges of the lens 44. As shown in FIGS. 1 and 2 the length of the lens 44 is less than the length of the housing 12 thereby defining at least one opening 50 into the interior of the housing 12. Preferably, the lens 44 is positioned centrally between the ends of the housing 12 creating a second opening 52 thereby defining a pair of openings 50, 52 at opposing ends of the lens 44 into the housing interior. Although not limited thereto, the principles of the present invention contemplate that a tungsten-halogen quartz lamp 54 is to be used in the fixture. These lamps generate considerable heat in operation and according to a very important aspect of the invention the pair of openings 50, 52 on either end of the lens provides for introduction and circulation of ambient air into and through the housing interior to cool the lamp 54 and reflector 30. Additional cooling is achieved by utilizing material for the housing 12 which has a high coeficient of thermal conductivity such as the extruded aluminum set out hereinabove. The housing is further provided with a plurality of grooves 56, 58, 60, 62 in the outer surface of the top wall 14 which increases surface area and heat dissipation from the housing 12 to the atmosphere.

As shown in FIGS. 1 and 2 the lamp 54 is mounted to the inner surface of one end cap 26 as described below between the lens 44 and the reflector 30 in a predetermined location relative to the reflector 30 so as to create a desired light pattern from the fixture 10. It can be seen that in the embodiment described herein, the lamp 54 is positioned above the principle longitudingal axis of the housing 12 and in close proximity to the upper portion of the reflector 30 and the top wall 14 of the housing 12. This location causes considerable heat to be concentrated at the top wall 14 which the grooves 62, 60, 58, 56 therein help to dissipate.

As stated, the reflector 30 is asymmetrically-shaped when viewed from the end. The asymmetrical cross sectional shape and elongated straight configuration creates an even, uniform, wide spread illumination pattern having sharp light cut-off at the top and bottom of the pattern. Additionally, as shown in FIGS. 1, 2, 4 and 5, the reflector 30 includes a blackened light absorbing portion along a pre-determined portion at the bottom thereof to prevent reflection of light from that portion of the reflector 30 back towards other portions of the reflector 30. This light absorbing portion further contributes to a light pattern having sharp cut-offs at the top and bottom thereof. It can be appreciated that the light pattern provides for cut-off of the light coincident with, for example, the interface between a ceiling and wall or any other straight interface between a pair of joining surfaces.

Referring principally to FIG. 6, each end cap 24, 26 is provided with a raised peripheral rim 64 complementary to the shape of the housing ends 20 and 22. Each end cap 24, 26 is removeably positioned across one of the respective open ends 22 and 20 with the peripheral rim 64 engaged over the top 14, back 18 and bottom walls 16 of the housing 12. A pair of stamped, generally rectangular shaped plates 66, 68 are affixed to the inner surface of each end cap 24, 26 with, for example, fasteners 70, 72 received in a pair of internally threaded bosses, not shown, cast into the end plates 66 and 68. The end plates 66, 68 are identical except that one, such as that designated 68 in FIG. 7, is provided with means for mounting a lamp socket 74 which holds and energizes the lamp 54. Each plate 66, 68 is provided with a pair of spaced apart retention tabs 76, 78 extending substantially parallel to the inner surface of the end plate 66, 68 and in spaced apart relationship therewith as shown best in FIGS. 7 and 10, the end of each plate 66, 68 adjacent the rear wall 18 defines a pair of stop surfaces 80, 82 which abut the respective ends such as the end 84 shown in FIG. 10, of the back wall 18 when the end caps 24, 26 are removed from the open ends 22, 20 of the housing 12 with the back wall 18 positioned between the tabs 76, 78 and inner surface of each end cap 24, 26, see FIG. 10.

Referring to FIG. 4 and 5, the back wall 18 is provided with a T-slot 86 which extends thereacross between the opposing ends 22, 20 of the housing 12. A strap like elongated bracket mounting plate 88 is slideably received in the slot 86 from either open end 22, 20 and is preferably affixed to the back wall 18 with a pair of fasteners 90, 92. Extending between each bracket mounting plate fastener 90, 92 or, if desired, some other connection point on the housing, and one of the retention tabs 76, 78 are a pair of springs 94, 96. It can be appreciated that with the end caps 24, 26 positioned against the housing 12 across the open ends 22, 20, the springs 94, 96 bias and hold the caps 24, 26 in place, thereby maintaining the housing 12 closed. It can also be appreciated that when the end caps 24, 26 are removed from the open ends 22, 20, as hereinabove described, and as shown best in FIG. 7, the springs 94, 96 bias the stop surfaces 80, 82 against the housing 12 ends which, with the retention tabs 76, 78, hold the end caps 24, 26 in the open position providing access the the housing 12 interior from either end 20, 22. According to a very important aspect of the invention, it can be appreciated that servicing of the components of the fixture 10 including lamp 54 replacement and removal and insertion of the reflector 30 and lens 44 is achieved from either open end 20, 22 by positioning either end cap 24, 26, or both, removed from their respective end 22, 20 of the housing 12. Reassembly is achieved by sliding the reflector 30 and lens 44 into their respective grooves 32, 34 and 36, 38 and repositioning the end cap or caps 24, 26 in the closed position.

Now, referring to FIG. 6, the fixture 10 is physically mounted and electrically connected to a track, not shown, of a track lighting system, also not shown in the drawings, with a novel mounting arrangement including the heretofore mentioned bracket mounting plate 88 to which up upstanding Y-shaped hanger 98 is affixed. The hanger 98 includes a pair of legs 100, 102 each of which is attached at one end to the plate 88. The hanger 98 is a two-piece member joined together at the junction of the legs 100, 102 to form a double thickness planar portion 104 at the free end thereof which double thickness tends to increase the strength of the mounting arrangement. Other constructions embodying the principles of the invention are possible including forming the Y-shaped hanger 98 from an elongated, one-piece strap, stamped or folded member to form the Y-shape and double thickness portion.

Rotationally attached to the planar portion 104 through a frictional attachment is an L-shaped mounting pad 106 to which an upstanding hollow decorative mounting stem 107 is affixed with at least one fastener 108. The mounting pad 106 to hanger 98 mounting is effected by a rivet or pin 112 extending through aligned clearance holes in the pad 106 and planar portion 104. A spring washer may be used between the pin and hanger to achieve additional frictional retention of the pad at selected angular positions relative to the hanger. The free end of the stem 107 is affixed to a track connector 120 which is well known in the art and which is adapted to electrically couple electrical leads 122, 124 which pass through the hollow stem to the electrical conductors within the track. The connector 120 also mechanically affixes the stem 107 to the track in wall known manner. Typically, the connector 120 is adapted to provide for rotation of the stem 107, and thus the fixture 10, in a plane lying parallel to the surface to which the track is mounted.

Figure 1A:
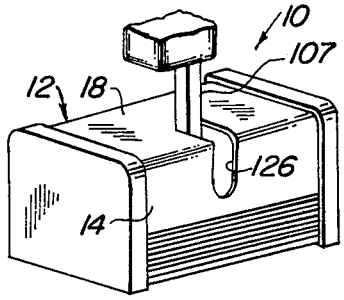
FIG. 1*a* is a perspective view similar to FIG. 1 wherein the housing has been rotated 90°.

As shown in FIG. 1*a*, the stem 107 passes through a slot 126 provided in portions of the top 14 and back walls 18 of the housing 12 and connects to the pad 106 internally of the housing 12 providing for an esthetically pleasing appearance. Also, the slot 126 is adapted to provide for pivotal movement of the housing 12 through an angle of at least 90°, as shown in FIG. 1*a*, which provides sufficient movement to effect desired lighting pattern changes.

Figure 8:
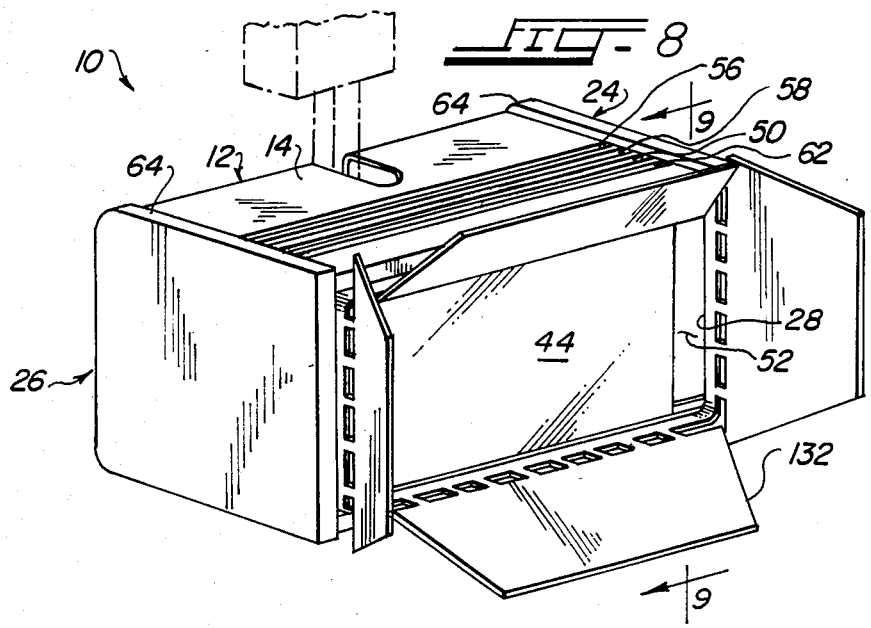
FIG. 8 is a perspective view of an alternate embodiment.
Figure 9:
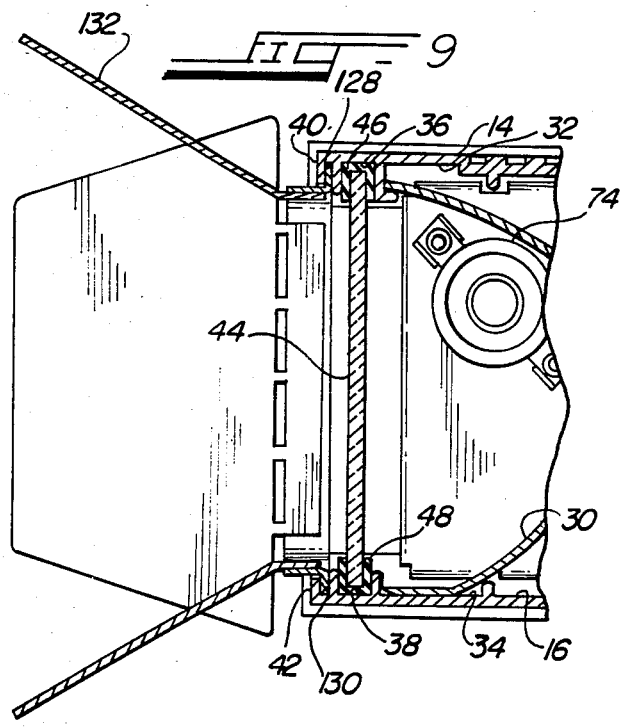
FIG. 9 is a view taken along the line 9—9 of FIG. 8.

As shown best in FIG. 9, the top 14 and bottom walls 16 of the housing 12 are also provided with a third outermost pair of aligned grooves 128, 130 at the front of the housing. These grooves 128, 130 are configured to slideably receive an accessory item such as a shutter 132 shown in FIGS. 8 and 9 or, for example, a color filter or baffle to achieve interchangeable special lighting effects.

OPERATION

In use, the connector 120 is secured to the electrical track of the track lighting system in well known manner and the vertical angle of the fixture 10 is adjusted by pivoting the housing 12. Many lighting effects can be achieved, for example, to illuminate an object on the wall or to illuminate an entire wall from floor to ceiling. In such case, the sharp light cut-off at the top and bottom provided by the fixture 10 of the present invention limits the light to only the wall. The light cut-off provides for framing of an object to be illuminated. Special effects can be achieved by removing one end cap 24, preferably that cap 24 opposite the lamp socket 74, from the housing 12 and sliding an accessory item such as a filter, shutter or baffle into the outermost groove of the housing 12 and then replacing cap 24. It can be seen that the structure provides for fast, easy changing of accessory items as well as servicing of the lamp 54, lens 44 and reflector 30 when required by removal of the end cap or caps 24, 26. The end caps 24 or 26, when removed can be stored in an open position without having to be completely disconnected from the fixture 10 by engaging the stops 80, 82 on the plates 66, 68 to the end of the housing such that the springs 94, 96 and tabs 76, 78 cooperate to hold the caps 24, 26 in the open position. A housing 12 constructed according to the principles of the present invention is safe, easily serviced and allows novel lighting effects by providing sharp light cut off at the top and bottom of a uniform field of spread illumination.

Having described the preferred embodiment of the invention, those skilled in the art having the benefit of the description and the accompanying drawings can readily device other embodiments and modifications. Therefore, said embodiments and modifications are to be considered to be within the scope of the appended claims.

I claim:

1. A lighting fixture for use in an electric track lighting system comprising:

a substantially channel shaped housing, said housing having a top wall, a back wall and a bottom wall;

at least two pair of aligned grooves formed on the top wall and the bottom wall of said housing;

a removable light reflector having a predetermined configuration mounted within one of said pairs of aligned grooves in the interior of said housing;

means for mounting and providing electrical current to a light source within said housing at a predetermined location relative to said light reflector;

at least one removable end cap constructed and arranged to enclose one end of said substantially channel shaped housing;

means for mounting said removable end cap to one end of said housing, said end cap mounting means adapted to provide retention of said end cap to said housing in a closed position and retention of said end cap to said housing in an open position which permits access to the interior of said housing; and means for mounting said housing and electrically coupling said means for mounting a light source to said electrical track;

wherein when said end cap is in its open position said light reflector may be easily removed from said housing for service by sliding it along the prir of aligned grooves in which it is maintained.

2. The lighting fixture as defined in claim 1 wherein said means for physically mounting and electrically coupling said means for mounting said light source comprises:

a bracket means affixed to said back wall of said housing;

an elongated stem having an internal passage therethrough pivotally attached at one end thereof to said bracket means;

electrical track connector means rotationally attached to a second end of said stem, said electrical track connector means adapted to removably mount to said electrical track and engage electrical contacts associated with said electrical track; and electrical leads connected to said electrical track connector contacts extending through said internal passage of said elongated stem to said means for mounting said light source.

3. The lighting fixture as defined in claim 2 wherein said bracket means comprises:

an elongated plate affixed to said back wall of said housing;

an upstanding hanger affixed to said elongated plate;

an L-shaped pad; and fastener means providing for frictional, pivotal attachment of said pad to said hanger, said stem being attached to said pad.

4. The lighting fixture as defined in claim 3 wherein said back wall includes slot means extending across said back wall between said opposing ends, said elongated mounting plate slideably received in said slot means.

5. The lighting fixture as defined in claim 1 further including a lens mounted in a pair of aligned grooves so that light reflected from said reflector passes through said lens.

6. The lighting fixture as defined in claim 5 wherein:

said lens being dimensioned and positionable with a pair of aligned grooves between said opposing ends of said housing so as to define at least one opening into the interior of said housing between one end of said lens and one of said opposing ends of said housing whereby cooling air has access to the interior of said housing.

7. The lighting fixture as defined in claim 6 wherein said reflector is slideably received in one pair of said aligned grooves, and said lens is slideably received in a second pair of said aligned grooves.

8. The lighting fixture as defined in claim 7 wherein said top wall and said bottom wall further include a third pair of outermost aligned grooves adjacent said open front configured to slideably receive a light fixture accessory item.

9. The lighting fixture as defined in claim 1 wherein said means for mounting said end cap comprises:

resilient means associated with said housing and said end cap for biasing said end cap against said housing when in said closed position; and stop means on said end cap associated with said resilient means, said stop means biased by said resilient means into engagement with said housing when said end cap is in the open position for retaining said end cap in the open position.

10. The lighting fixture as defined in claim 9 comprising:

a plate affixed to the inner surface of said end cap defining a stop surface adapted to engage said housing when said end cap is in said open position; and a spring connected between said housing and said plate, said stop surface biased against said housing by said spring when said end cap is in the open position.

11. The lighting fixture as defined in claim 10 further comprising:

at least one end cap retention tab on said plate adjacent to said stop surface extending therefrom in spaced apart substantially parallel relationship with the inner surface of said end cap; and said back wall of said housing, extending between said opposing ends of said housing and having an edge thereof at said open end of said housing, said edge being received in the space between said tab and the inner surface of said end cap and abutting said stop surface on said plate when said end cap is in the open position.

12. The lighting fixture as defined in claim 11 further comprising:

a second end cap retention tab on said plate adjacent to said stop surface, said second end cap retention tab being spaced apart from and coplanar with the other end cap retention tab.

13. A lighting fixture for use in an electrical track lighting system comprising:

an substantially channel shaped housing having a top, a bottom, a back connected between said top and said bottom and being open at the front and having opposing ends;

means associated with said top and said bottom for mounting a light reflector within said housing;

means associated with said top and said bottom for mounting a lens across said open front, said channel shaped housing and said lens forming at least one open end at one of said opposed ends;

a pair of end caps each mounted and in constant retention to said housing at a respective one of said opposing ends for alternative positioning and retention in a first closed position across said open end against said housing and in a second open position allowing access through said open end;

means for mounting a light source to the inner surface of one of said pair of end caps between said reflector and said lens at a predetermined location relative to said reflector; and means for mounting said housing to said electrical track including means for electrically coupling said means for mounting said light source to electrical contacts in said electrical track, said means for mounting said housing providing for independent relative pivotal and rotational movement between said housing and said electrical track;

wherein when said end cap is in its open position the combination of the open end and said mounting means enhances the servicability and replacement of those components located within said housing.

14. The lighting fixture as defined in claim 13 further comprising:

a pair of plates, one plate affixed to the inner surface of each of said end caps, each said plate defining a stop which abuts said housing when said end cap is in said second position removed from said open end, each said plate, including at least one tab, extending therefrom in spaced apart, substantially parallel relationship with the inner surface of said end cap, said back wall being positioned between said tab and said end cap when said end cap is positioned in the second position; and a pair of springs, one spring affixed between said housing and said tab on each of said plates, each of said spring constructed and arranged to bias each of said end caps against said housing when in the first position across said open end and biases each said stop into abutment with said housing when said end cap is in said second position removed from said open end.

15. The lighting fixture as defined in claim 13 wherein said means for mounting said housing to said electrical track further comprises:

a slot in said back wall;

an elongated strap-like bracket mounting plate slideably received in said slot;

a hanger member affixed to said bracket mounting plate extending upwardly from said bracket mounting plate and being substantially perpendicular to said top; and a mounting pad frictionally mounted to said hanger member for rotation and retention at selected angular positions relative to said hanger member;

whereby said fixture may be positioned in an angular relationship with respect to said electrical track.

16. The lighting fixture as defined in claim 15, further comprising:

an elongated hollow stem passing through said slot in said top and being affixed at one end to said mounting pad; and connector means rotationally connected to said stem at a second end thereof said connector means adapted for attachment to said electrical track and includes electrical contacts adapted to engage electrical connections on said electrical track.

17. A lighting fixture as defined in claim 15 wherein said hanger member is a Y-shaped strap like member having a pair of legs each affixed to said bracket mounting plate and having a double thickness planar portion frictionally mounted to said mounting pad.

18. A lighting fixture as defined in claim 13 wherein said top and said bottom include a first pair of aligned grooves extending between said opposing ends, said reflector slideably received in said first pair of grooves; and a second pair of intermediate aligned grooves between said open front and said first pair of grooves extending between said opposing ends, said lens, slideably received in said second pair of grooves.

19. The lighting fixture as defined in claim 18 wherein said top and said bottom further comprise:

a third pair of aligned grooves at the open front adapted to slideably receive a lighting fixture accessory item.

20. The lighting fixture as defined in claim 18 wherein said reflector is assymetrically shaped and extends between said opposing ends said assymetrical shape providing for a sharp cut-off at the top and bottom of an emanating light beam.

21. The lighting fixture as defined in claim 20 wherein a predetermined portion of said reflector adjacent said bottom wall is adapted to absorb light thereby preventing reflection of light back into said reflector and providing a sharp cut-off of an emanating light beam.

22. A lighting fixture for use in an electrical track lighting system comprising:

a channel shaped housing having a top wall, a bottom wall, a back wall, and having an open front and a pair of opposing open ends;

a first end cap positioned at one of said opposing ends;

first plate means attached to an inner surface of said first end cap defining a stop and including at least one first tab extending therefrom toward said rear wall in spaced apart substantially parallel relationship with the inner surface of said first end cap;

a first spring attached between said rear wall and said first tab biasing said first end cap against said housing when positioned across said one of said open ends and biasing said stop against said housing when position removed from said one open end with said housing between said first tab and the inner surface of said first end cap;

a second end cap positioned at the second of said opposing ends;

second plate means attached to the inner surface of said second end cap defining a second stop and including at least one second tab extending therefrom toward said rear wall in spaced apart substantially parallel relationship with an inner surface of said second end cap;

a second spring attached between said rear wall and said second tab biasing said second end cap against said housing when positioned across said second of said open ends and biasing said second stop against said housing when position removed from said second open end with said housing between said second tab and the inner surface of said second end cap;

a first pair of aligned grooves in said top wall and said bottom wall;

an elongated asymetrically shaped light reflector having opposing edges respectively slideably received in said first pair of grooves, said reflector extending between said first and said second end caps and being configured to reflect light therefrom through said open front in a predetermined pattern;

a second pair of aligned grooves in said top wall and said bottom wall outboard of said first pair of grooves;

a light transparent lens having opposite edges slideably received in said second pair of grooves, said lens having a length defining a pair of openings between opposite ends thereof and said respective end caps when positioned in said second pair of grooves;

means for mounting and energizing a light source to said end cap at a predetermined location relative to said reflector;

said back wall including slot means extending between said opposing ends of said housing for slideably receiving an elongated bracket mounting plate therein;

an upstanding hanger member affixed to said bracket mounting plate extending therefrom substantially perpendicular to said top wall of said housing;

an L-shaped mounting pad affixed to a free end of said hanger member for frictional, rotational movement relative to said hanger member;

a hollow mounting stem affixed at one end thereof to said mounting pad and extending through a slot in said top wall and said back wall at the interface of said top wall and said back wall;

a connector rotationally affixed to an end of said stem opposite said mounting pad and including means promoting for slidable mounting thereof to said track and including electrical contact means for making electrical contract with said electrical track; and electrical leads coupled to said electrical contact means passing through said housing stem and being electrically coupled to said means for mounting and energizing said source.

23. The lighting fixture as defined in claim 22 wherein said mounting pad to hanger member attachment provides for rotation of said housing through an angle of at least 90°.

* * * * *